US005873200A

United States Patent [19]

Henderson

[11] Patent Number: 5,873,200

[45] Date of Patent: Feb. 23, 1999

[54] GATE OPENER

[75] Inventor: Niko Austin Henderson, Canyon Country, Calif.

[73] Assignee: Court Security Systems, Inc., Valencia, Calif.

[21] Appl. No.: 910,580

[22] Filed: Jul. 26, 1997

[51] Int. Cl.[6] ..... E05F 11/24

[52] U.S. Cl. ..... 49/343; 49/340; 49/49; 74/89.15

[58] Field of Search ..... 49/49, 326, 333, 49/334, 339, 340, 343; 74/89.15, 104

[56] References Cited

U.S. PATENT DOCUMENTS

| | | | |
|---|---|---|---|
| 876,166 | 1/1908 | Gard | 49/334 |
| 1,570,483 | 1/1926 | Hammerl | 49/343 X |
| 2,130,851 | 9/1938 | Baron | 49/343 X |
| 3,877,174 | 4/1975 | McDonald | 49/334 |

*Primary Examiner*—Jerry Redman
*Attorney, Agent, or Firm*—Ted Masters

[57] ABSTRACT

A 90° gate opener (20) includes a screw (22), and a nut (30) which travels along screw (22) as the screw (22) is turned by a motor (46). One end of a main arm 32 is pivotally connected to nut (30) so that it also travels along screw (22). Screw (22) is dispositioned a predetermined distance (D) behind a pivot (38) which slidably receives main arm (32). As screw (22) is turned, main arm (32) rotates approximately 90° about pivot (38), and in so doing also slides through pivot (38). As a result of the increased mechanical advantage of the gate opener, a motor of smaller horsepower rating may be utilized. Gate opener (20) may be used in either horizontal or vertical applications.

14 Claims, 8 Drawing Sheets

GATE OPENER

TECHNICAL FIELD

The present invention pertains to gate openers, and in particular to gate openers used to open and close the vehicle access gates of gated residential communities or other secure facilities.

BACKGROUND ART

Gate openers which are utilized to open and close vehicular gates are well known in the art. Upon receipt of an electronic signal, these devices cause the gate to open or close. During the opening or closing process, the gate typically moves through 90°, and takes approximately 15 seconds to do so (2 rpm). The movement of the gate is controlled by a motor, a gear reduction unit, typically 900 to 1, which connects the motor to a primary arm, and a secondary arm which connects the primary arm to the gate. The gear reduction unit is quite inefficient, and occasions an unnecessary expenditure power. In operation, the motor, through the gear reduction unit, turns the primary arm through either 180° or 360° depending upon the specific opener design. This rotation causes the secondary arm to pull(open) or push(close) the gate through its 90° path.

DISCLOSURE OF INVENTION

The present invention is directed to an improved gate opener which only requires 90° of primary arm rotation to achieve the necessary 90° of gate motion. The present invention employs a novel lever arm concept wherein an internal lever arm design provides increased mechanical advantage. This is particularly important during the gate closing process, where only a portion of the gate opener's power can be delivered to the gate through the acutely angled primary and secondary arms. The present invention is also useful when the gate is being opened, where increased torque is provided to overcome the inertia of the gate. Because of the screw and pivot point design of the present invention, less power is required during the gate closing operation, and therefore a motor of smaller horsepower rating can be utilized. The present invention utilizes a ⅙ horsepower motor, whereas conventional gate openers typically use at least a ½ horsepower motor. Further, the design of the present invention causes the gate to move more slowly when it is near either the fully closed or fully open positions. This affords benefits both in safety and reduced power requirements.

A unique feature of the present invention resides in the fact that the gate opener can be used to open either vertically suspended swinging gates, or to open barrier-type entry gates. In the former case, the present invention is oriented so that the main arm moves in a horizontal plane, In the later case, the present invention is turned 90°, so that the main arm moves in a vertical plane.

In accordance with a preferred embodiment of the present invention, a gate opener includes a screw having a first end, an opposite second end, and a central longitudinal axis running therebetween. A nut threadably engages the screw. A main arm, which is substantially coplanar with the screw, has a first end and an opposite second end, the first end is pivotally connected to the nut. A pivot is disposed a predetermined distance behind the screw, the pivot being pivotable about a pivot axis which is substantially perpendicular to the longitudinal axis. The pivot has a thruhole which slidably receives the main arm.

In accordance with an important aspect of the invention, the pivot is equidistant from the ends of the screw.

In accordance with an important feature of the invention, a rotation means turns the screw so that the nut longitudinally travels along the screw thereby carrying with it the first end of the main arm. In a preferred embodiment the rotation means includes a direct current motor which is coupled by gearing to the first end of the screw.

In accordance with another important aspect of the invention, the main arm rotates through an angle of approximately 90° as the nut moves from the first end of the screw to the second end of the screw.

In accordance with another important feature of the invention, either a first high voltage or a second low voltage may be applied to the motor, the second low voltage being applied when the nut is near either the first or the second end of the screw.

In accordance with an important aspect of the invention, the first end of the main arm has a yoke which connects to the nut.

In accordance with an important feature of the invention, the nut and the pivot are fabricated from a polymer.

In accordance with another important aspect of the invention, the gate opener further includes a sensing means for sensing the position of the nut along the screw. In a preferred embodiment the sensing means includes a sensor screw which carries two limit nuts which actuate two corresponding limit switches.

In accordance with another important feature of the invention, the gate opener may be oriented so that the main arm moves horizontally, or the gate opener may be oriented so that the main arm moves vertically.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
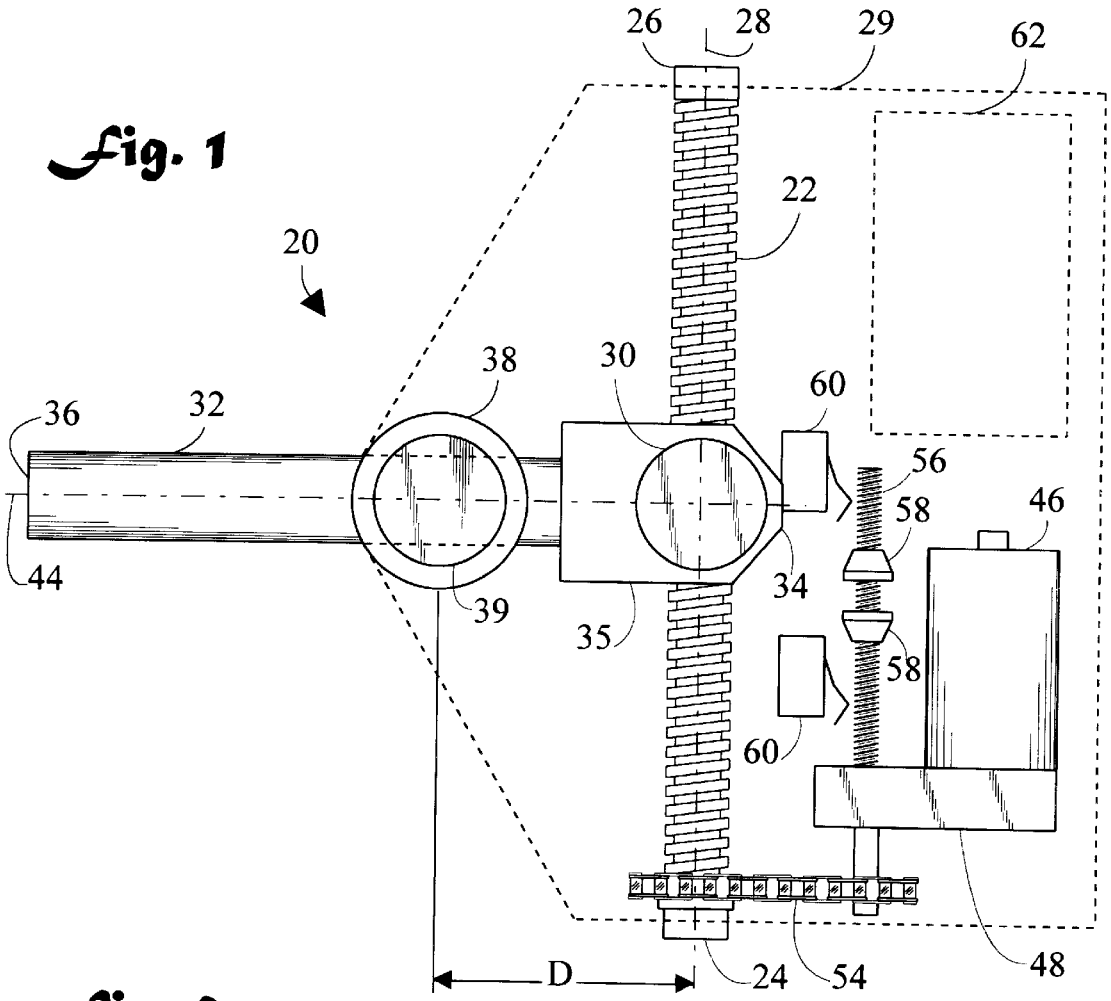
FIG. 1 is a top plan view of a gate opener in accordance with the present invention.
Figure 2:
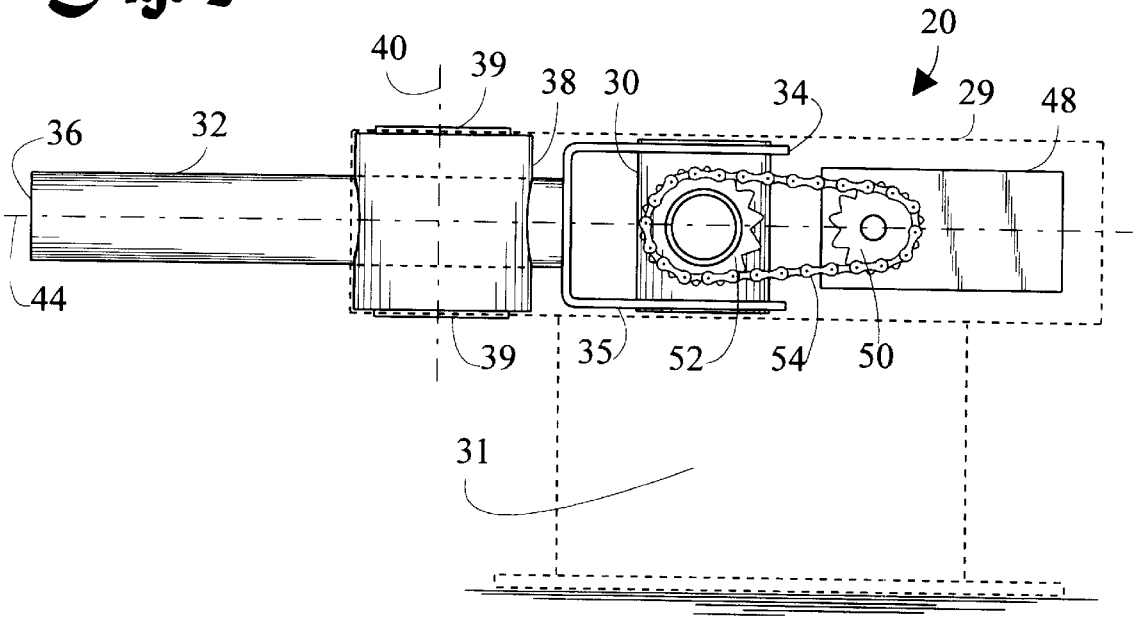
FIG. 2 is a side elevation view of the gate opener.

Referring initially to FIGS. 1 and 2, there are illustrated top plan and side elevation views respectively of a gate opener in accordance with the present invention, generally designated as 20. Gate opener 20 includes a screw 22 having a first end 24, an opposite second end 26, and a longitudinal axis 28. In a preferred embodiment, screw 22 has four threads per inch. Both first end 24 and second end 26 of screw 22 are connected to gate opener housing 29 by bearings which allow screw 22 to turn. Gate opener housing 29 surrounds the gate opener 20 components, and further includes a pedestal 31 which supports the gate opener 20 above the ground. A nut 30 threadably engages screw 22. A main arm 32 has a first end 34 and an opposite second end 36, and is substantially coplanar with screw 22. First end 34 is pivotally connected to nut 30. In a preferred embodiment, first end 34 of main arm 32 includes a yoke 35 which connects to nut 30(refer also to FIG. 5). A pivot 38 is disposed a predetermined distance D from screw 22. In a preferred embodiment, distance D is approximately six inches. Pivot 38 is pivotable about a pivot axis 40 which is substantially perpendicular to longitudinal axis 28 of screw 22. Pivot 38 has two circular plateaus 39 which are received by holes in gate opener housing 29, thereby retaining pivot 38 in place. Pivot 38 also has a thruhole 42 which slidably receives main arm 32, and allows main arm 32 to pivot about pivot axis 40 (also refer to FIG. 5). In the embodiment shown, main arm 32 and receiving thruhole 42 have a circular cross section, however other shapes could also be utilized. Screw 22 further has a traverse axis 44 which is perpendicular and coplanar with longitudinal axis 28. Traverse axis 44 is substantially equidistant from first end 24 and second end 26 of screw 22 so that it passes substantially through the center of screw 22. In a preferred embodiment, pivot 38 is disposed on traverse axis 44. The central symmetrical placement of pivot 38 with respect to screw 22 allows gate opener 20 to be used with either clockwise or counterclockwise opening gates.

A rotation means causes screw 22 to turn so that nut 30 travels along screw 22 and carries with it first end 34 of main arm 32. In the preferred shown embodiment, the rotation means includes a ⅙ horsepower direct current (dc) motor 46 which is coupled by gearing to first end 24 of screw 22. The gearing includes a 19 to 1 reduction gear assembly 48, a first ten tooth sprocket 50 connected to the reduction gear assembly 48, a second fifteen tooth sprocket 52 connected to first end 24 of screw 22, and a chain 54 connecting the two sprockets. Motor 46 can operate by applying either a first high voltage of 24 volts, or a second low voltage of 12 volts. With +24 volts applied the motor 46 will turn at a high rpm in one of a clockwise or counterclockwise direction, and with +12 volts applied the motor 46 will turn at a low rpm in one of a clockwise or counterclockwise direction. This causes screw 22 to turn at two speeds thereby causing nut 30 to move at two speeds along screw 22. Application of −24 volts or −12 volts causes motor 46 to turn in the other of a clockwise or counterclockwise direction.

A sensing means senses the position of nut 30 along screw 22, and when nut 30 is near either first end 24 or second end 26 of screw 22, causes the second low voltage of 12 volts to be applied in that region, thereby slowing down the speed of nut 30. Since nut 30 slows down, the rotation of main arm 32 also slows down, which causes gate 500 to slow down when it is near either the fully open or fully closed position (refer also to FIGS. 6 and 7). In the preferred embodiment shown, the sensing means includes a sensor screw 56 which carries two limit nuts 58 which actuate two corresponding limit switches 60. Limit switches 60 have two positions. The first position causes the voltage to direct current motor 46 to be reduced thereby slowing down the main arm 32, and the second position causes the voltage to be removed, thus stopping the travel of nut 30 and the movement of main arm 32. The electronics, including the remote control circuitry necessary for the operation of gate opener 20 are located on circuit board 62.

Figure 3:
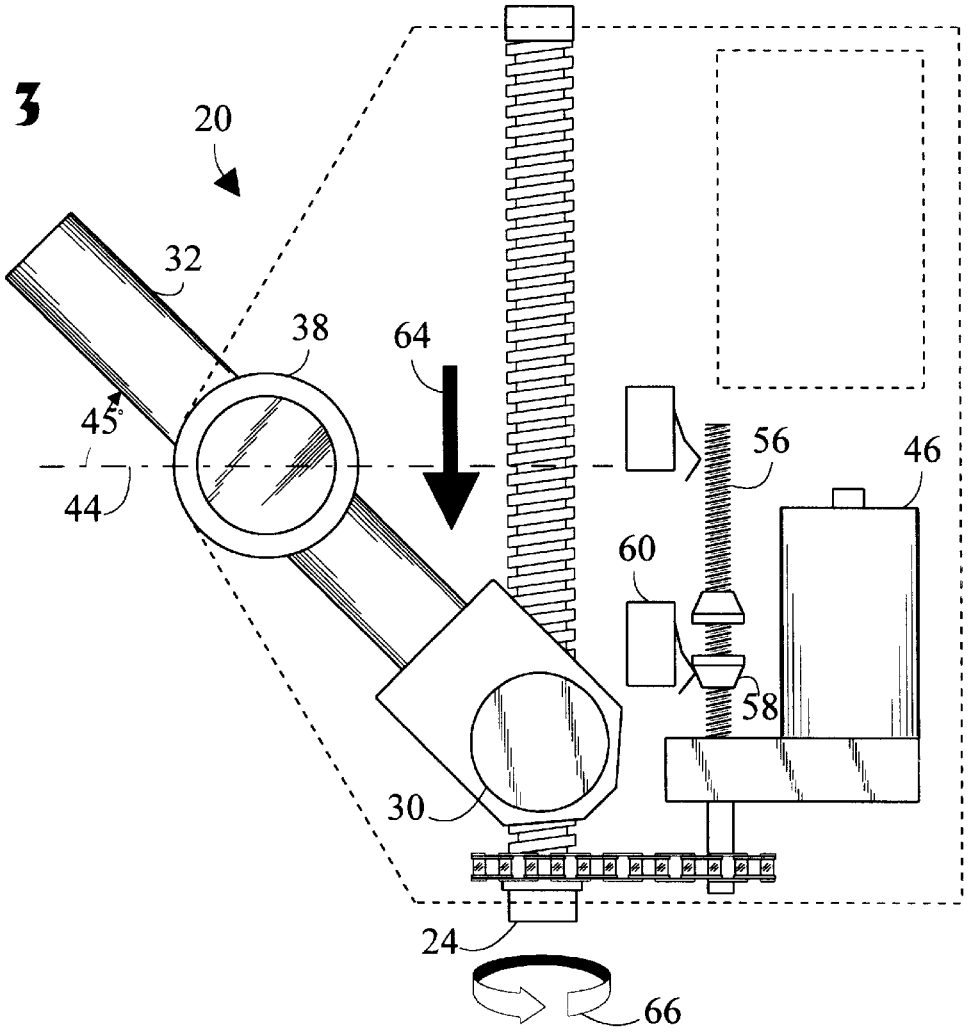
FIG. 3 is a top plan view showing the nut moved toward the first end of the screw.

FIG. 3 is a top plan view showing nut 30 moved in direction 64 to its furthest excursion toward first end 24 of screw 22. Motor 46 turns causing screw 22 to turn in clockwise direction 66 thereby pulling nut 30 toward first end 24. Limit nut 58 first engages the first position of limit switch 60 which causes motor 46 to reduce speed. Limit nut 58 then engages the second position of limit switch 60 which causes motor 46 to stop. At the furthest point, main arm 32 forms and angle of approximately 45° with traverse axis 44.

Figure 4:
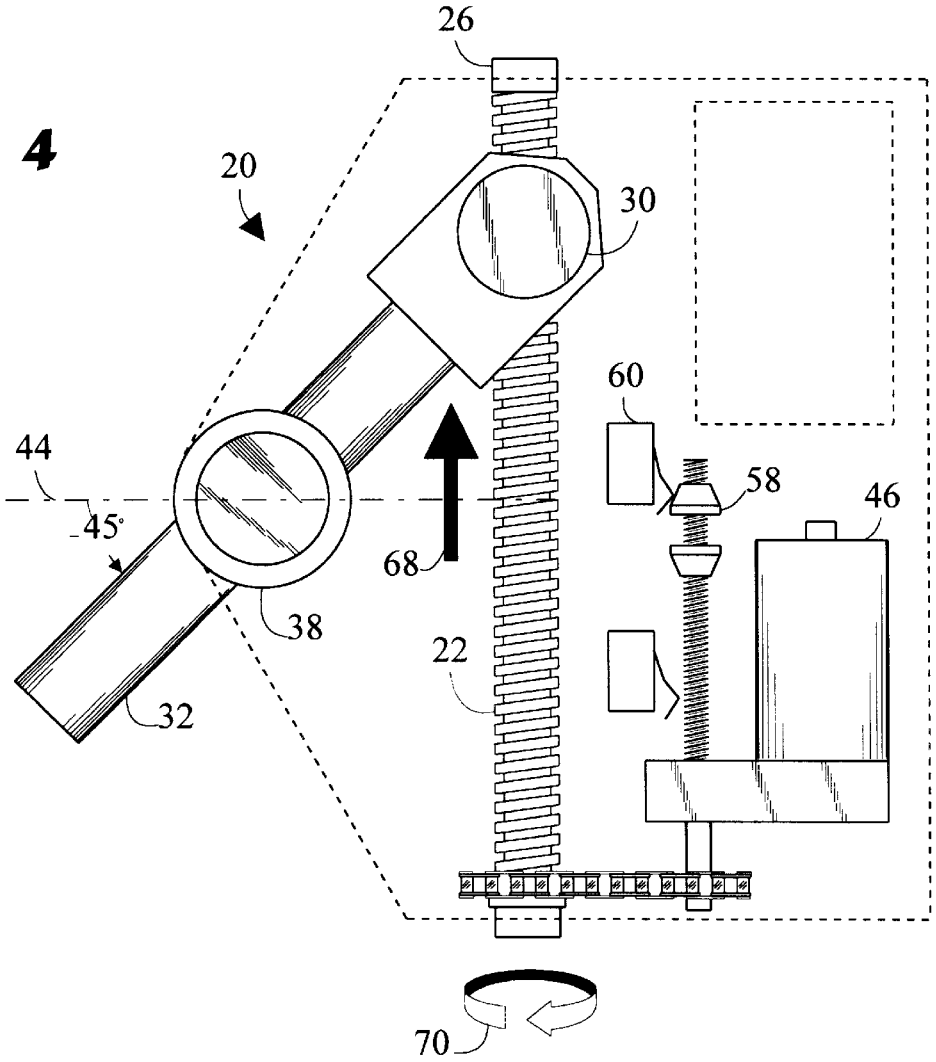
FIG. 4 is a top plan view showing the nut moved toward the second end of the screw.

FIG. 4 is a top plan view showing nut 30 moved in direction 68 to its furthest excursion toward second end 26 of screw 22. Motor 46 turns causing screw 22 to turn in counterclockwise direction 70 thereby pushing nut 30 toward second end 26. Limit nut 58 first engages the first position of limit switch 60 which causes motor 46 to reduce speed. Limit nut 58 then engages the second position of limit switch 60 which causes motor 46 to stop. At the furthest point, main arm 32 forms and angle of approximately −45° with traverse axis 44. Therefore, main arm 32 rotates through an angle of approximately 90° as nut 30 moves from the first end 24 of screw 22 to the second end 26 of screw 22.

Figure 5:
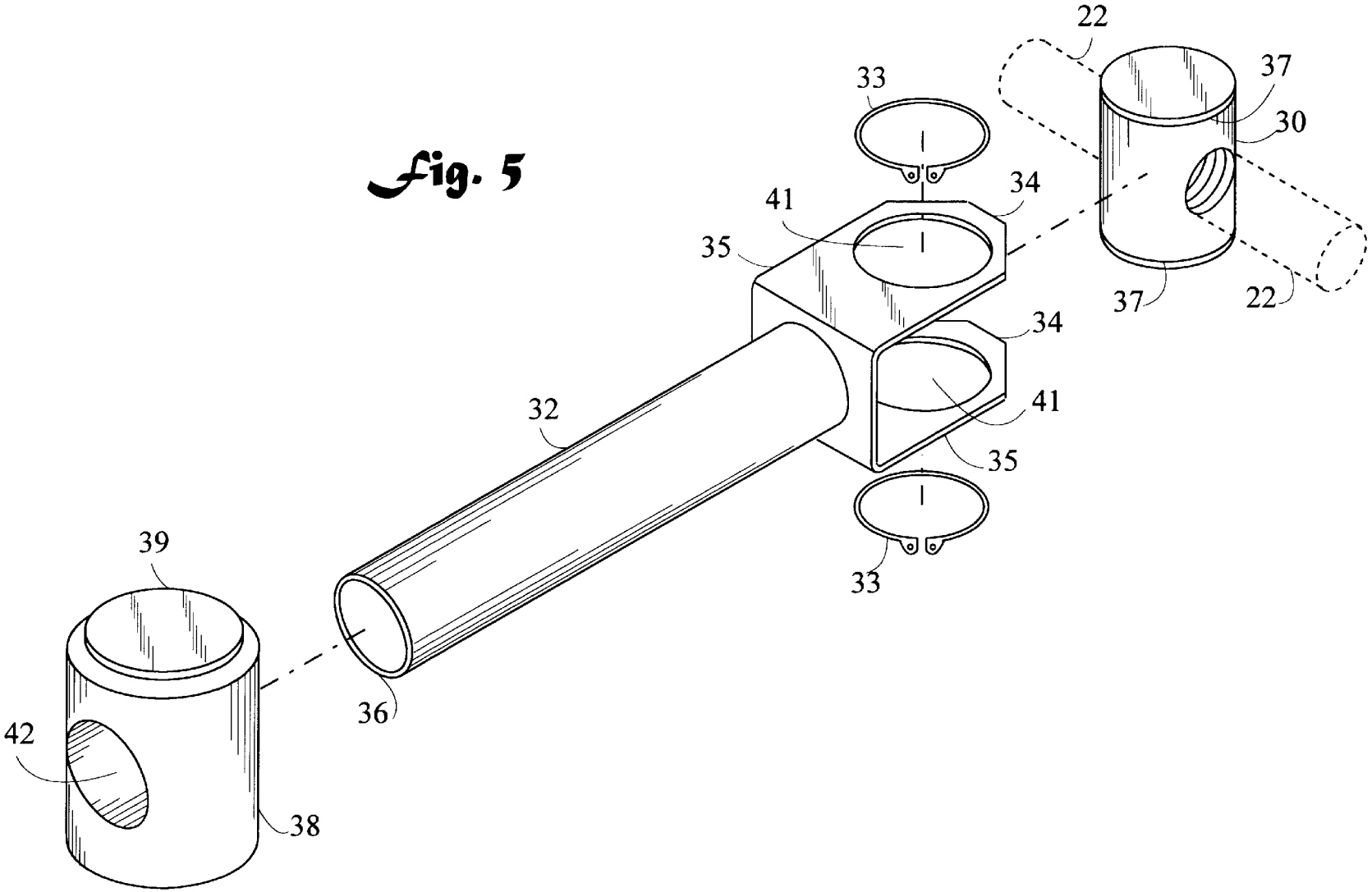
FIG. 5 is an enlarged exploded perspective view of the pivot, the main arm, and the nut.

FIG. 5 is an enlarged exploded perspective view of pivot 38, main arm 32, and nut 30. Pivot 38 has thruhole 42 which slidably accepts main arm 32. Pivot 38 also has top and bottom circular plateaus 39 which engage circular holes in gate opener housing 29 (refer to FIGS. 1 and 2) to hold pivot 38 securely in place. Main arm 32 consists of a tubular portion and yoke 35 at first end 34. Yoke 35 has two holes 41 which accept nut 30. Nut 30 is held in place in yoke 35 by means of two retaining clamps 33 which engage grooves 37 in nut 30. Yoke 35 firmly holds both the top and bottom of nut 30 so that nut 30 will not twist as it travels along screw 22.

Figure 6:
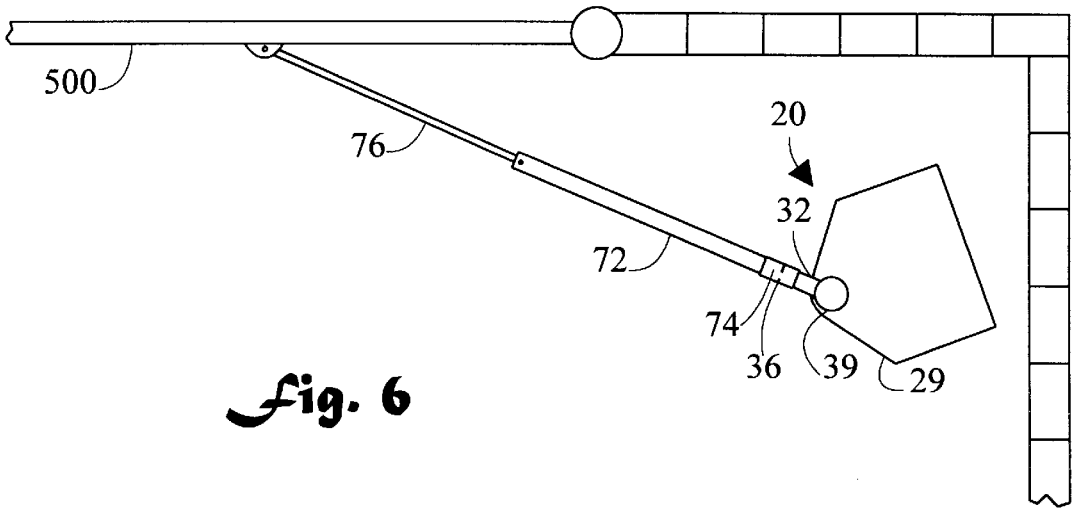
FIG. 6 is a reduced top plan view of the gate opener attached to a vertically suspended swinging gate in the closed position.

FIG. 6 is a reduced top plan view of gate opener 20 attached to a vertically suspended swinging gate 500 in the closed position. The second end 36 of main arm 32 is connected to a primary arm 72 by means of a collar 74. The opposite end of primary arm 72 is pivotally connected to a secondary arm 76. The opposite end of secondary arm 76 is in turn pivotally connected to gate 500. In this embodiment, main arm 32 moves horizontally.

Figure 7:
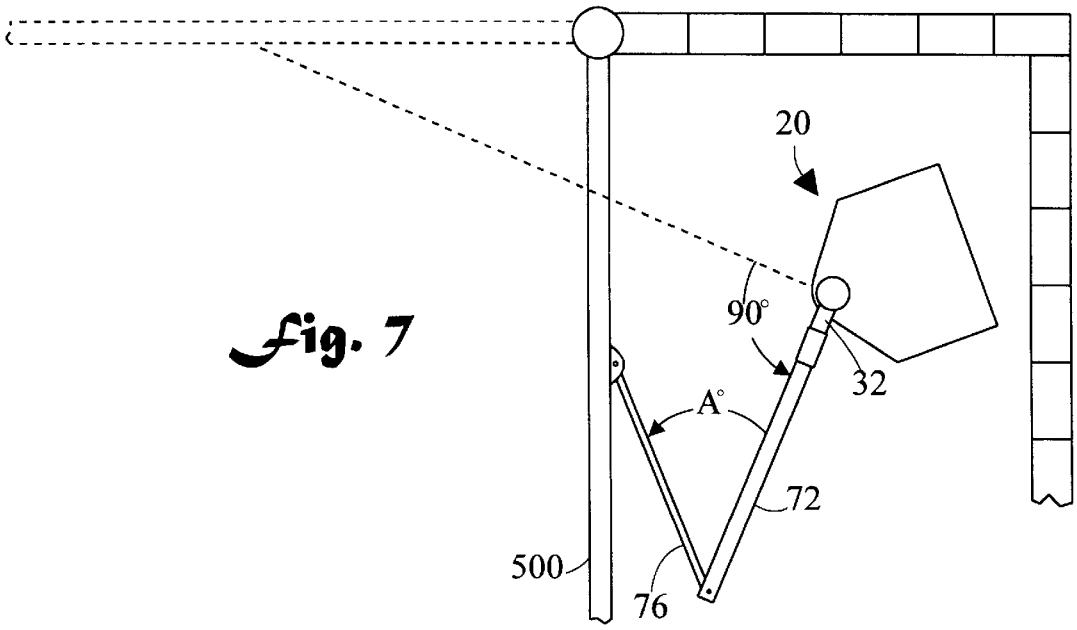
FIG. 7 is a reduced top plan view of the gate opener with the gate in the open position.

FIG. 7 is a reduced top plan view of gate opener 20 with gate 500 in the open position. From the initial position of FIG. 6, primary arm 72 has been rotated by gate opener 20 through 90° thereby opening gate 500. Primary arm 72 and secondary arm 76 form an acute aspect angle A°

Figure 8A:
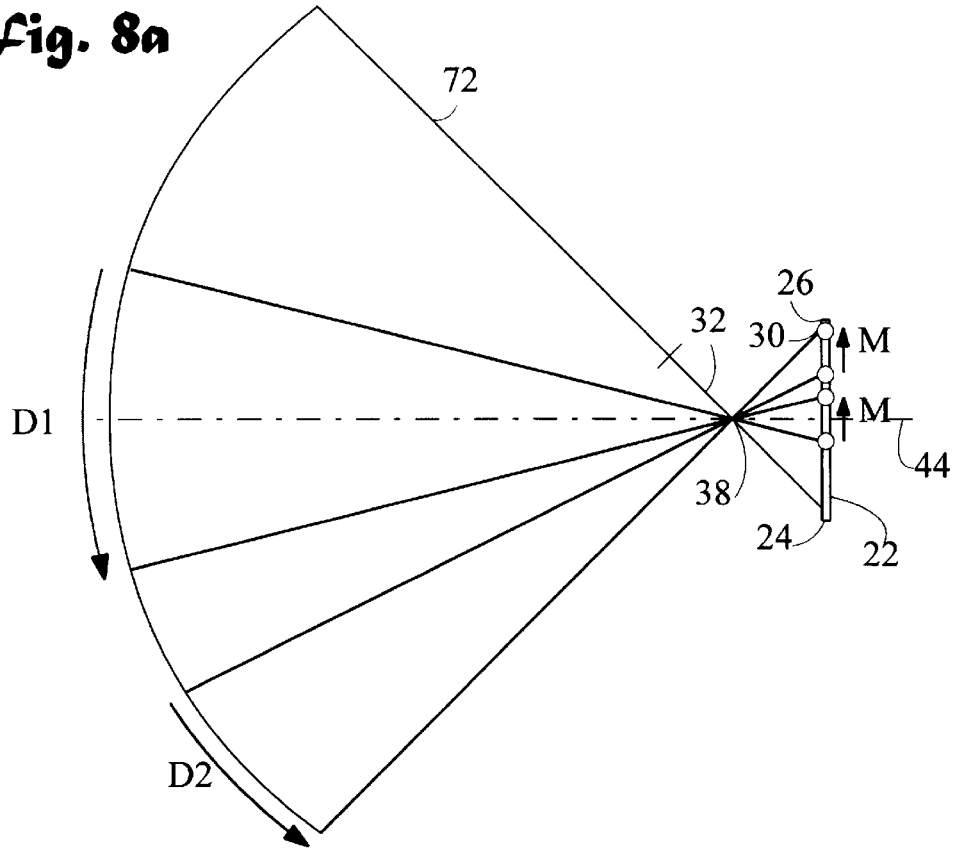
FIG. 8*a* is a simplified diagram showing the path followed by the primary arm.
Figure 8B:
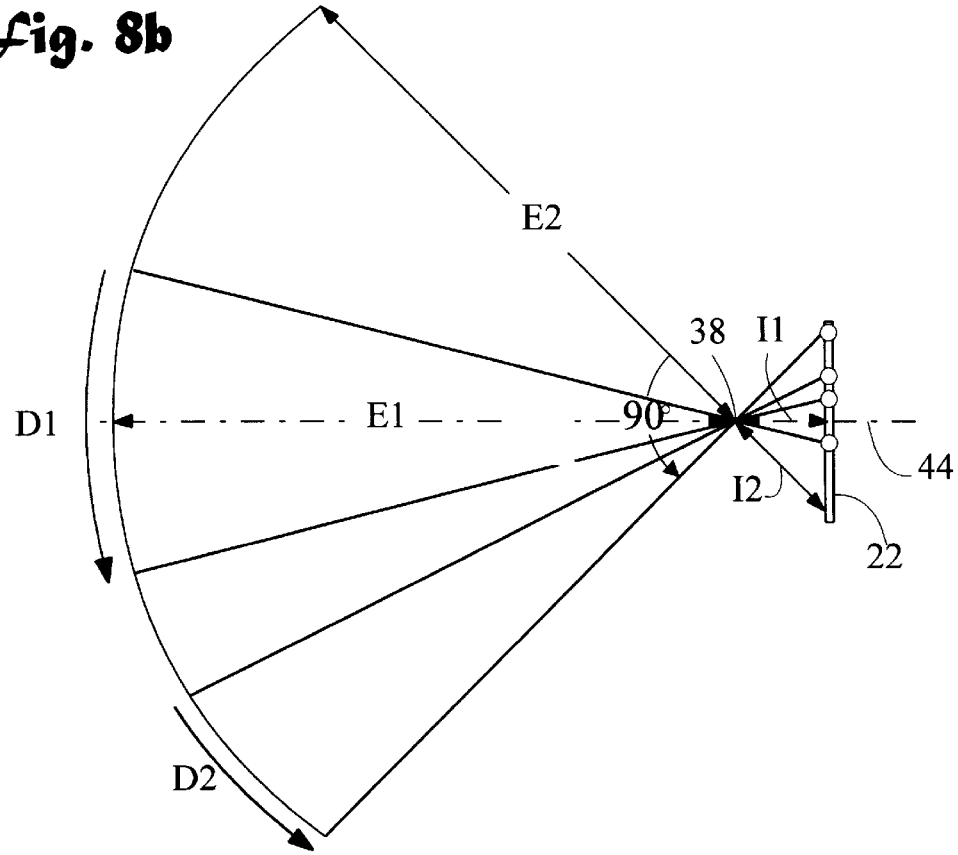
FIG. 8*b* is a simplified diagram showing the internal and external lever arms.

FIGS. 8*a* and 8*b* are simplified diagrams showing the path followed by primary arm 72 as it rotates through 90°, and the internal and external lever arms respectively. It may be observed that for a given movement M of the nut 30 along screw 22, the movement of primary arm 72 varies according to the position of nut 30 along screw 22. That is, when nut 30 is near traverse axis 44, primary arm 72 sweeps an arc D1. However, when nut 30 is near first end 24 (or second end 26), primary arm 72 sweeps a smaller arc D2. This in effect serves to slow down the motion of gate 500 when it is near either the fully open or fully closed position. When gate 500 is closing, this is useful in that it allows more time to get out of the way. Conversely, when gate 500 is being opened, it means that less motor 46 energy is required as a function of time, and that therefore a motor 46 of smaller horsepower rating can be utilized.

Additionally, it is noted that the external lever arm (primary arm 72+extending portion of main arm 32) is longest, having a value of E1, when it is aligned with traverse axis 44. On the other hand, the external lever arm is shortest, having a length of E2, when nut 30 has been driven to either end of screw 22. This is of course occasioned by the fact that as nut 30 moves toward either end of screw 22, main arm 32 is slidably drawn inward through pivot 38. This is very important when the gate 500 is being closed. By having a shorter external lever arm, less torque is required to move the gate, and again a smaller rated motor 46 can be utilized.

A key design feature of the present invention is the fact that screw 22, nut 30, and attached first end 34 of main arm 32 are positioned behind pivot 38 thereby creating an internal lever arm which provides mechanical advantage when moving gate 500. This lessens the required motor 46 torque and horsepower. In FIG. 8*b,* the internal lever arms I1 and I2 apply to external lever arms E1 and E2 respectively. By moving screw 22 even further from pivot 38 (increasing predetermined distance D, refer to FIG. 1), the mechanical advantage can be additionally increased. Of course in practice, the limiting factor becomes the size of gate opener 20.

Figure 9:
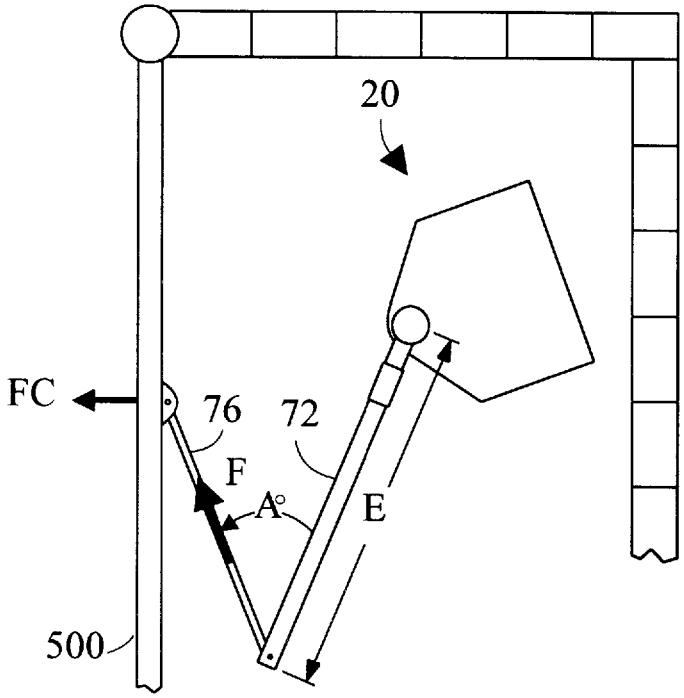
FIG. 9 is a top plan view showing the closing force delivered to the gate by the gate opener.

FIG. 9 is a top plan view showing the closing force Fc delivered to gate 500 by gate opener 20. Closing gate 500 is the most difficult task for gate opener 20 because small angles are involved, and consequently all of the rotational force of primary arm 72 cannot be delivered to gate 500. Primary arm 72 delivers force F to gate 500 through secondary arm 76. Only Fc, the component of F which is perpendicular to gate 500, is useful in closing the gate 500. However, for the present invention, it is noted that since the external lever arm E is minimum at the fully open position, aspect angle A° is increased over what it would be if the external lever arm did not shorten in length. This in turn increases the value of F along the secondary arm 76, and correspondingly increases the value of Fc. Again, this feature results in a smaller torque and horsepower requirements.

Figure 10:
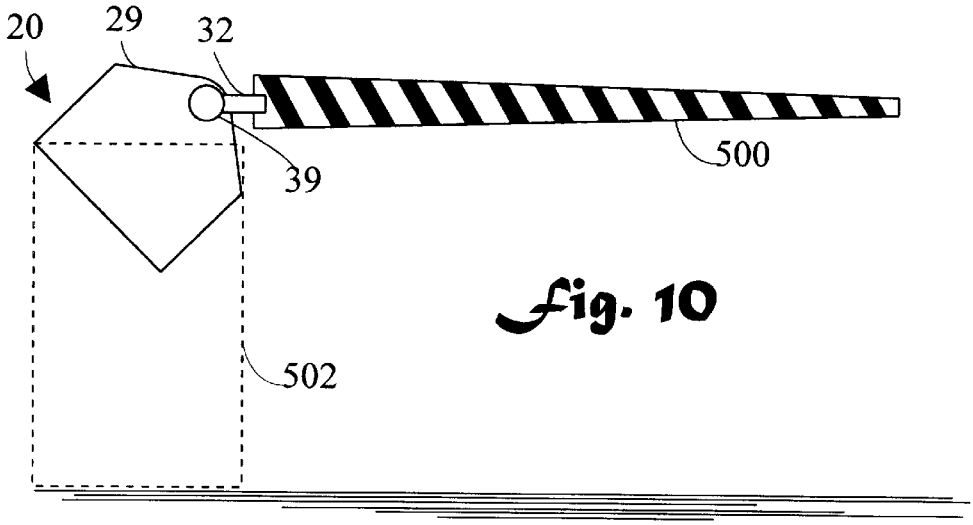
FIG. 10 is a side elevation view of the gate opener connected to a barrier-type entry gate in the closed position; and, FIG. 11 is a side elevation view of the gate in the open position.

FIG. 10 is a side elevation view of the gate opener 20 connected to a barrier-type entry gate 500 in the closed position. Gate opener 20 has been turned 90° from the substantially horizontal position shown in FIG. 6, to a substantially vertical position where main arm 32 now moves vertically rather than horizontally. Gate opener 20 including housing 29 is connected to a support structure 502.

Figure 11:
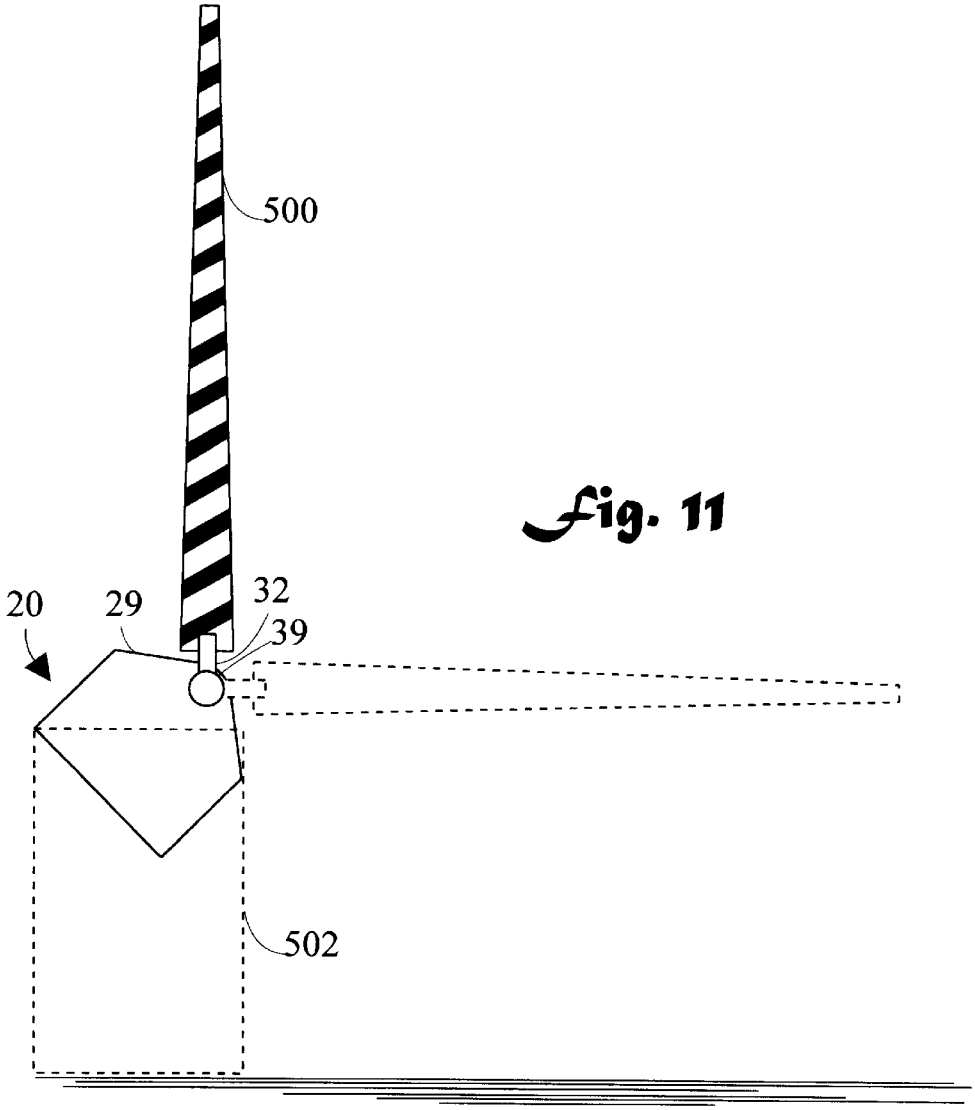

FIG. 11 is a side elevation view of the gate 500 of FIG. 10 in the open position. Main arm 32 has rotated 90° causing gate 500 to open.

In a preferred embodiment, screw 22 is fabricated from a lead/steel alloy. Main arm 32 is fabricated from an intermediate carbon steel. Nut 30 and pivot 38 are fabricated from UHMW which is a polyethylene copolymer to which a "carbon black" ultra violet inhibitor has been added.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A gate opener, comprising:

a screw having a first end, an opposite second end, and a longitudinal axis;

a nut threadably engaging said screw;

a main arm having a first end and an opposite second end, said first end pivotally connected to said nut, said main arm substantially coplanar with said screw; and, a pivot disposed a predetermined distance from said screw, said pivot pivotable about a pivot axis which is substantially perpendicular to said longitudinal axis, said pivot having a thruhole which slidably receives said main arm.

2. A gate opener according to claim 1, further including said screw having a traverse axis perpendicular to and coplanar with said longitudinal axis, said traverse axis substantially equidistant from said first and second ends of said screw, and said pivot disposed on said traverse axis.

3. A gate opener according to claim 1, further including a rotation means for turning said screw so that said nut longitudinally travels along said screw thereby carrying said first end of said main arm.

4. A gate opener according to claim 3, said rotation means further including a motor coupled by gearing to said first end of said screw.

5. A gate opener according to claim 3, wherein said main arm rotates through an angle of approximately 90° as said nut moves from said first end of said screw to said second end of said screw.

6. A gate opener according to claim 5, wherein at least one of a first high voltage and a second low voltage is applied to said motor, said second low voltage being applied when said nut is near either said first or second end of said screw.

7. A gate opener according to claim 3, further including:

a primary arm connected to said second end of said main arm;

a secondary arm connected to said primary arm; and said primary arm connected to a gate.

8. A gate opener according to claim 1, said first end of said main arm having a yoke which connects to said nut.

9. A gate opener according to claim 1, wherein said nut and said pivot are fabricated from a polymer.

10. A gate opener according to claim 1, further including a sensing means for sensing the position of said nut along said screw.

11. A gate opener according to claim 10, wherein said sensing means includes a sensor screw which carries two limit nuts which actuate two corresponding limit switches.

12. A gate opener according to claim 1, wherein said main arm moves horizontally.

13. A gate opener according to claim 1, wherein said main arm moves vertically.

14. A gate opener according to claim 1, further including:

said screw having a traverse axis perpendicular to and coplanar with said longitudinal axis, said traverse axis substantially equidistant from said first and second ends of said screw, and said pivot disposed on said traverse axis;

a rotation means for turning said screw so that said nut longitudinally travels along said screw thereby carrying said first end of said main arm;

wherein said main arm rotates through an angle of approximately 90° as said nut moves from said first end of said screw to said second end of said screw;

said rotation means further including a motor coupled by gearing to said first end of said screw, and wherein at least one of a first high voltage and a second low voltage is applied to said motor, said second low voltage being applied when said nut is near either said first or second end of said screw;

a sensing means for sensing the position of said nut along said screw; and, said first end of said main arm having a yoke which connects to said nut.

* * * * *